US011851941B2

(12) United States Patent
Seppänen et al.

(10) Patent No.: US 11,851,941 B2
(45) Date of Patent: Dec. 26, 2023

(54) HOLD-OPEN ARRESTER ARRANGEMENT HAVING A HOLD-OPEN FUNCTION TO HOLD A DOOR OPEN

(71) Applicant: Abloy Oy, Joensuu (FI)

(72) Inventors: Sauli Seppänen, Joensuu (FI); Juhani Karvonen, Kuopio (FI)

(73) Assignee: ABLOY OY, Joensuu (FI)

( * ) Notice: Subject to any disclaimer, the term of this patent is extended or adjusted under 35 U.S.C. 154(b) by 139 days.

(21) Appl. No.: 17/535,011

(22) Filed: Nov. 24, 2021

(65) Prior Publication Data

US 2022/0162894 A1 May 26, 2022

(30) Foreign Application Priority Data

Nov. 25, 2020 (EP) ..... 20209670

(51) Int. Cl.
*E05F 3/22* (2006.01)

(52) U.S. Cl.
CPC ..... *E05F 3/222* (2013.01)

(58) Field of Classification Search
CPC ..... E05F 3/222; E05F 2003/228; E05F 3/22
See application file for complete search history.

(56) References Cited

U.S. PATENT DOCUMENTS 4,016,381 A * 4/1977 Rodseth ..... H01H 3/161 200/61.7
4,286,412 A 9/1981 Stevens
4,750,236 A 6/1988 Teague, Jr.
5,044,680 A * 9/1991 Baker ..... E05C 17/28 49/31
5,082,316 A * 1/1992 Wardlaw ..... E05B 47/0002 292/201
5,878,530 A * 3/1999 Eccleston ..... E05F 15/63 49/340
7,537,038 B2 * 5/2009 Hsieh ..... E06B 9/74 49/141
11,619,087 B2 * 4/2023 Seppänen ..... E05F 3/222 16/49

FOREIGN PATENT DOCUMENTS

DE 102014211549 A1 * 12/2015 ..... E05F 3/222
DE 10 2017 210 363 A1 12/2018
EP 2434078 A2 3/2012
EP 3971378 A1 * 3/2022 ..... E05C 17/28

* cited by examiner

*Primary Examiner* — Victor D Batson
*Assistant Examiner* — Matthew J Sullivan
(74) *Attorney, Agent, or Firm* — Muncy, Geissler, Olds & Lowe

(57) ABSTRACT

A hold-open arrester arrangement has a low power consumption, and therefore a battery lifetime is long in the embodiments of the invention utilizing the battery. The hold-open arrester arrangement has a hold-open arrester arrangement having a hold-open function to hold a door open. The arrangement has also an electric release arrangement. The release arrangement is arranged to release the hold-open function in a fire alarm situation. The hold-open arrester arrangement comprises a sliding block and an arrester unit. The sliding block is connectable with a slide rail in a sliding manner and also pivotable connectable to an arm of a door closer. The arrester unit is connectable to the slide rail and has a body, said electric release arrangement, and said hold-open function with the sliding block.

21 Claims, 5 Drawing Sheets

HOLD-OPEN ARRESTER ARRANGEMENT HAVING A HOLD-OPEN FUNCTION TO HOLD A DOOR OPEN

FIELD OF TECHNOLOGY

Figure 1:
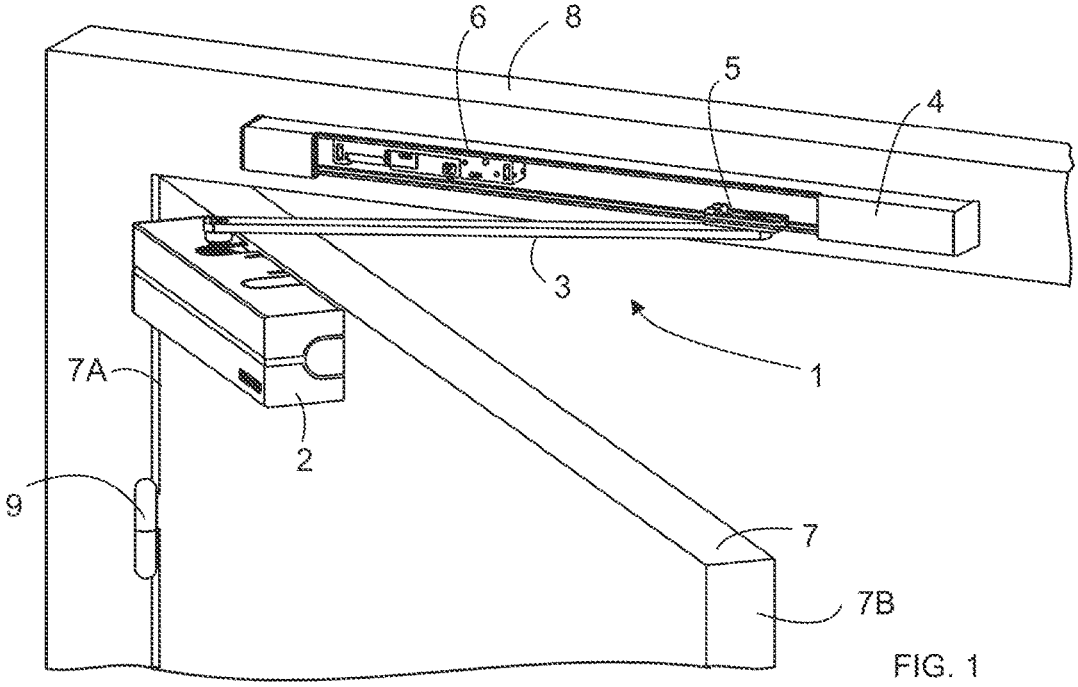

The invention relates to a hold-open arrester arrangement having a hold-open function to hold a door open. The hold-open arrester is arranged to be installed to a slide rail, which is in connection with a door closer through an arm of the door closer and a sliding block. The hold-open function is formed when the sliding block is in a locking connection with the hold-open arrester. Especially, the invention relates to a hold-open arrester having also an electric release arrangement. The release arrangement is arranged to release the hold-open function in a fire alarm situation

PRIOR ART

Hold-open arresters are devices, which are used with door closers to hold doors open. Doors may be desired to keep open on daytime in hospitals, schools, libraries etc. The hold-open arrester is installed to a slide rail in a fixed manner. The hold-open arrester is in connection with a door closer through an arm of the door closer and a sliding block. When opening the door, the sliding block moves along the slide rail until it meets the hold-open arrester. The attachment between the sliding block and the hold-open arrester is made. Therefore, the sliding block cannot slide back due to the force of the door closer, and the door is hold open. So, the sliding block is in a locking connection with the hold-open arrester.

U.S. Pat. Nos. 4,286,412, 4,750,236 and EP 2434078 show hold-open arresters installed to a slide rail, which embodiments have also a solenoid. DE 102017210363 shows a hold-open arrester for a slide rail. This arrester has a mechanical holding and releasing function utilizing a guide track.

In fire situations doors should be closed in order to prevent propagation of the fire. Therefore, there are hold-open arresters having an electric release arrangement. The electric release arrangement is arranged to release the hold-open function in a fire alarm situation. When the hold-open function is released the sliding block can move back to a position where the door is closed, and therefore the door is closed when the fire situation is detected.

Although, the known solutions work as designed they can be still improved, like power consumption and lifetime of a possible battery with the hold-open arrester.

Short Description

The object of the invention is to provide an alternative hold-open arrester arrangement. The object is achieved in a way described in the independent claim.

Dependent claims illustrate different embodiments of the invention. The inventive arrangement has a low power consumption, and therefore a battery lifetime is long in the embodiments of the invention utilizing the battery. The door can also be turned fully opened passing the opening angle of the door where the hold-open arrester arrangement is arranged to keep the door open.

An embodiment according to the invention has a hold-open arrester arrangement having a hold-open function to hold a door open, and also having an electric release arrangement. The electric release arrangement is arranged to release the hold-open function in a fire alarm situation. The inventive arrangement comprises a sliding block 5 and an arrester unit 6, the sliding block 5 being connectable with a slide rail 4 in a sliding manner and also pivotable connectable to an arm 3 of a door closer. The arrester unit 6 is connectable to the slide rail 4 and has a body 6B, the electric release arrangement, and said hold-open function with the sliding block 5. The body has a front end 6D and a rear end 6E.

The sliding block 5 comprises a support surface 11 and a pivoted lever 12 having a front surface 13 and a back surface 15. The pivoted lever is spring biased towards a locking position where the front surface 13 is in contact with the support surface 11.

The arrester unit 6 comprises a locking lever 19 having a cam 20. The arrester unit comprises also a slide element 14 being spring-biased towards an arresting position of the slide element 14. The slide element 14 at the arresting position is arranged to keep the locking lever 19 at a holding location. The cam 20 is out of the body 6B at the holding location.

The pivoted lever 12 is arranged to turn due to the cam 20 when the sliding block 5 is passing the arrester unit 6 towards the rear end 6E of the arrester unit. The pivoted lever is also arranged to turn back to the locking position after passing the cam 20 whereby the arrester unit 6 provides said hold-open function due to the cam 20 being out of the body 6B. The sliding block 5 is also capable to pass the rear end 6E of the arrester unit 6. So, the door can also be turned fully opened passing the opening angle of the door where the hold-open arrester arrangement is arranged to keep the door open.

The electric release arrangement is arranged to move the slide element 14 towards the rear end 6E in case of fire alarm whereby releasing said locking lever 19 from the holding location allowing the sliding block 5 to move away from the arrester unit 6 by passing the front end 6D of the arrester unit.

The arrester unit 6 further comprises an overload lever 21 being arranged to turn from its normal position in case a force from the sliding block 5 affecting to the overload lever 21 via the locking lever 19 is greater than a threshold force value. The turning of the overload lever 21 allows the locking lever 19 to move towards a front end 6D of the arrester unit, and to turn out of way of the sliding block. Thereby the movement of the sliding block 5 is allowed away from the arrester unit 6. The threshold force value is depending on a holding spring 28 that is arranged to bias the overload lever 21 to the normal position.

LIST OF FIGURES

Figure 2:
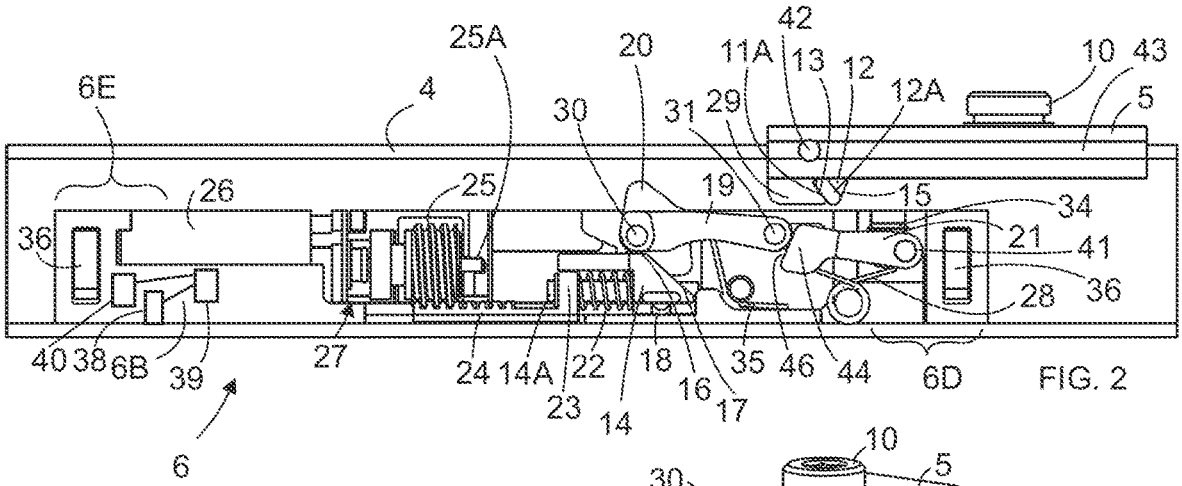
Figure 3:
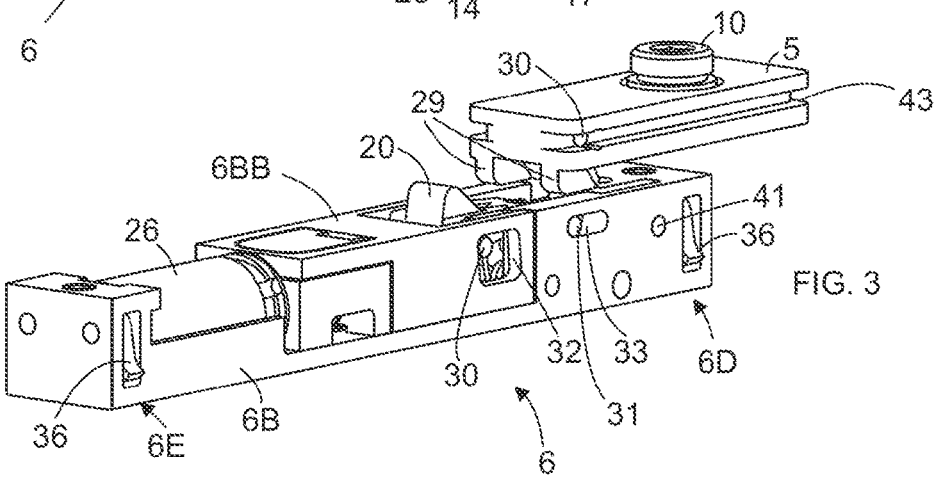
Figure 4:
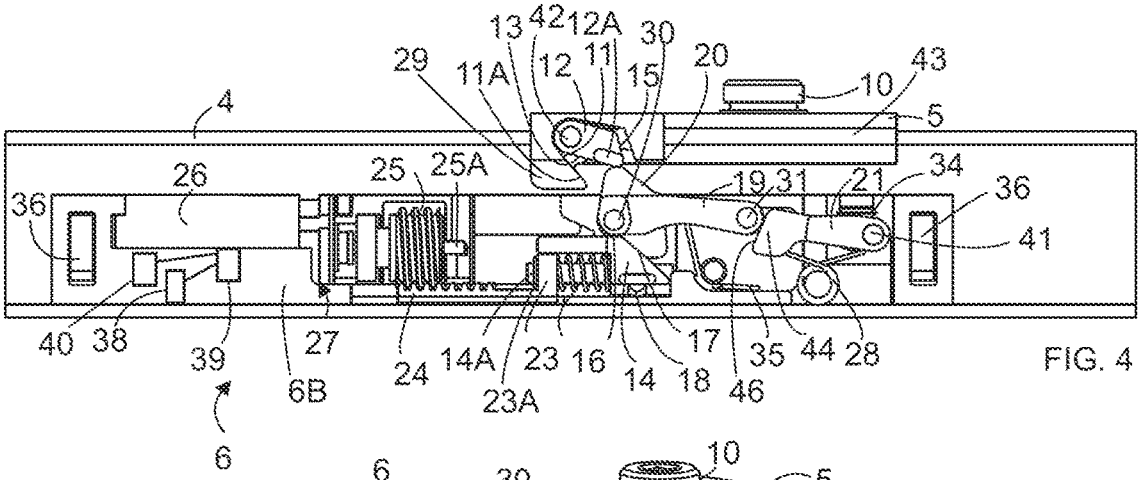
Figure 5:
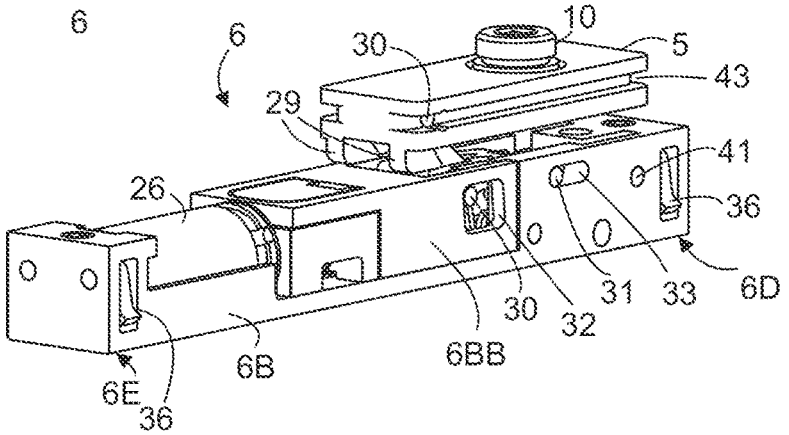
Figure 6:
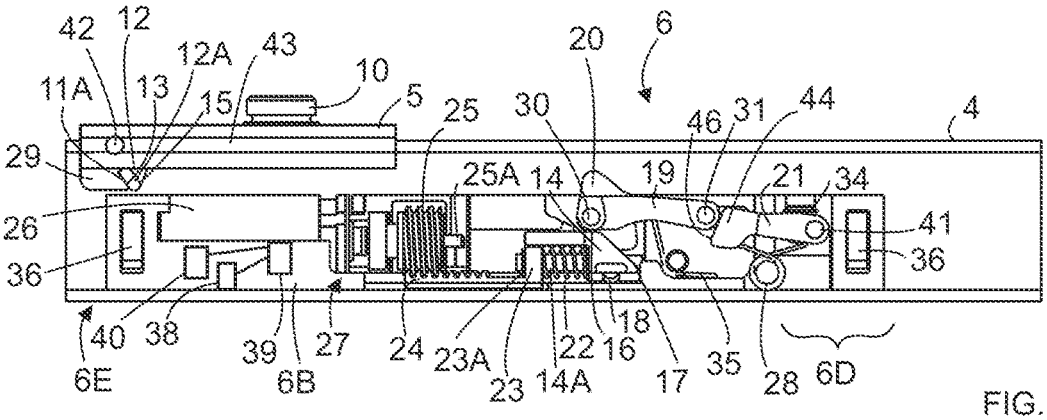
Figure 7:
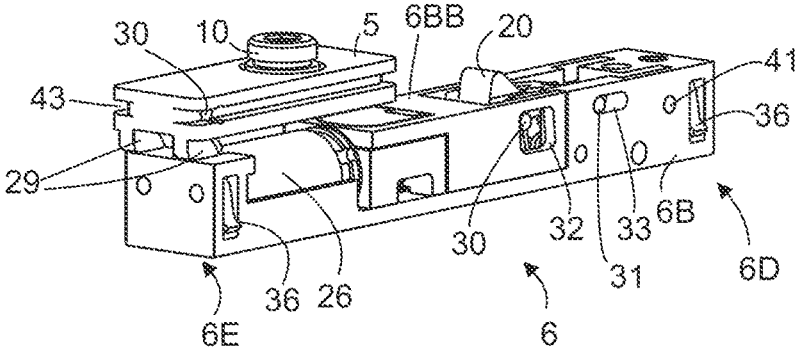
Figure 8:
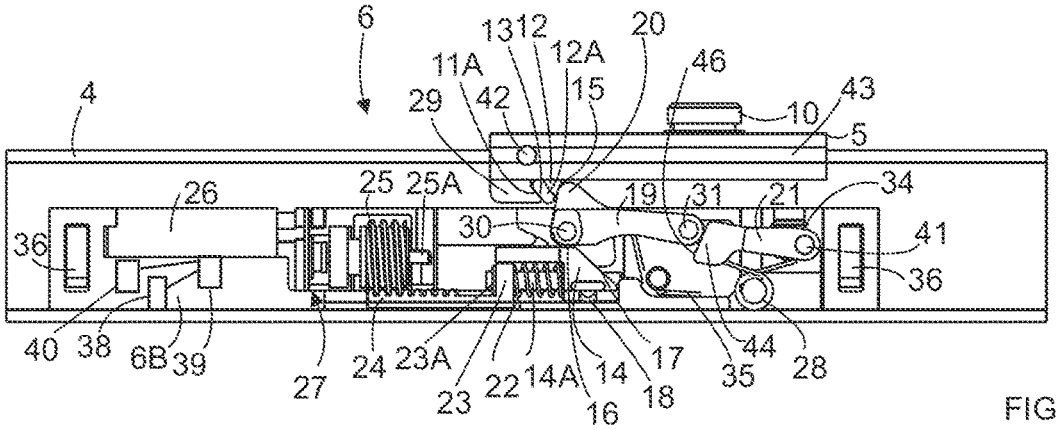
Figure 9:
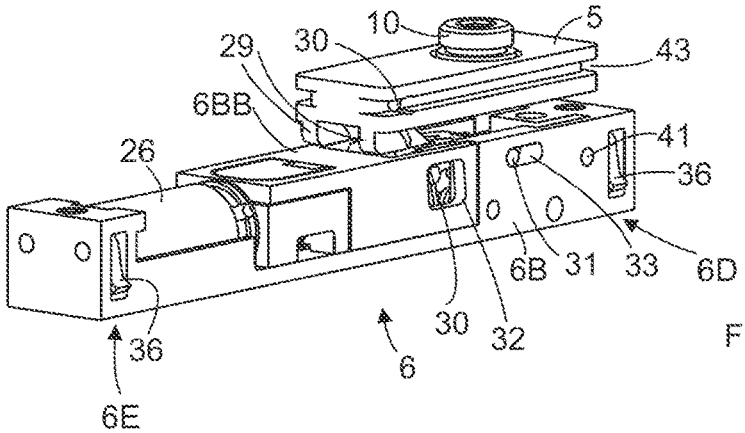
Figure 10:
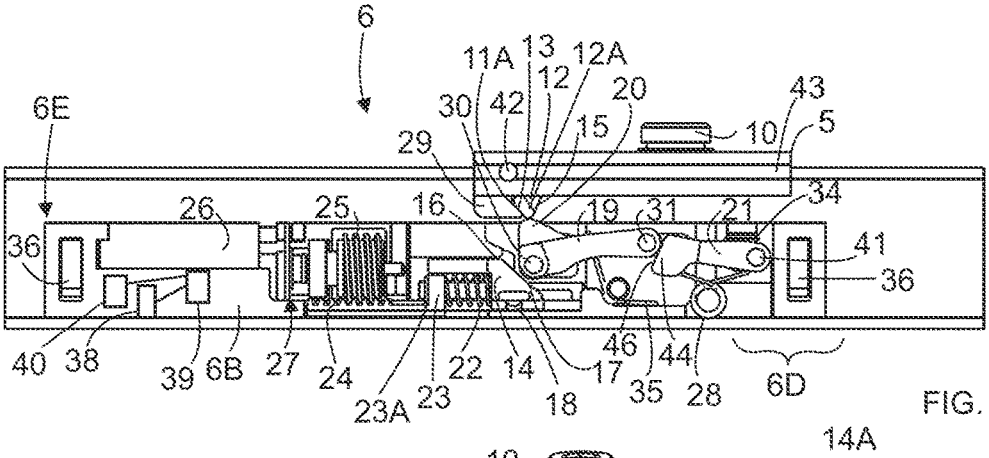
Figure 11:
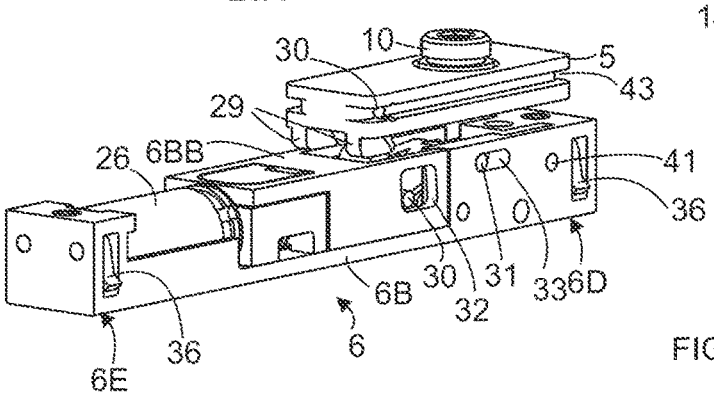
Figure 12:
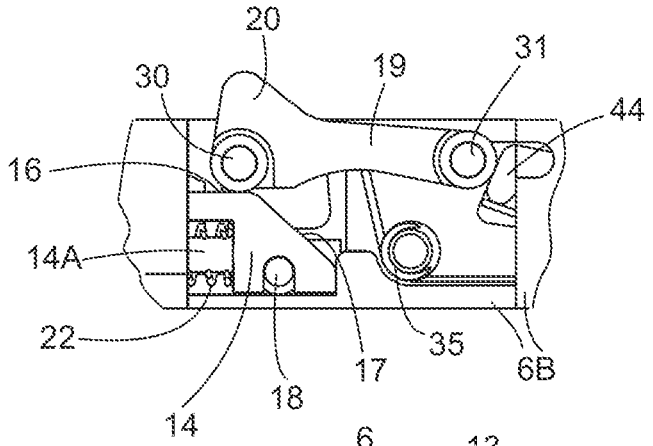
Figure 13:
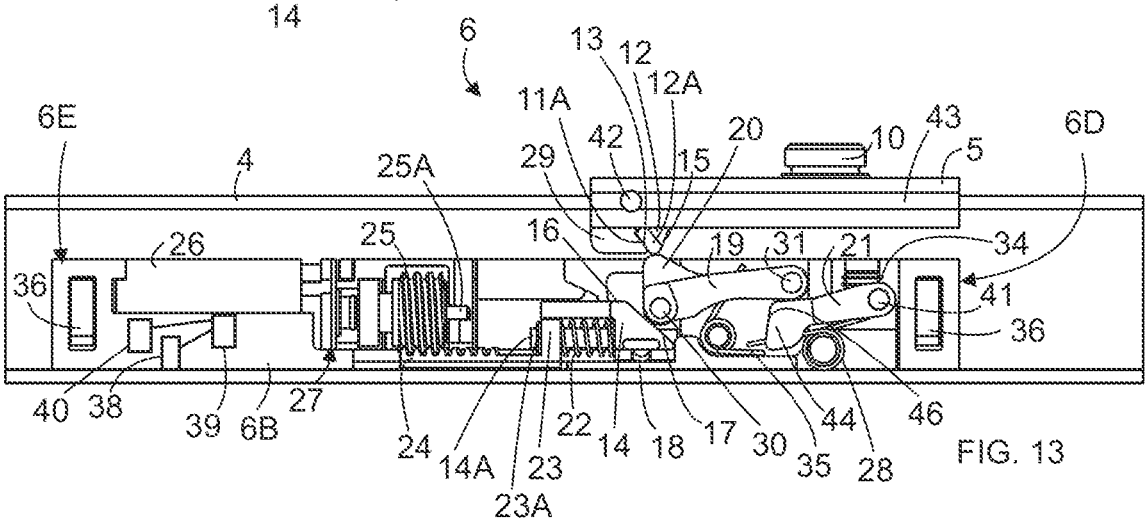
Figure 14:
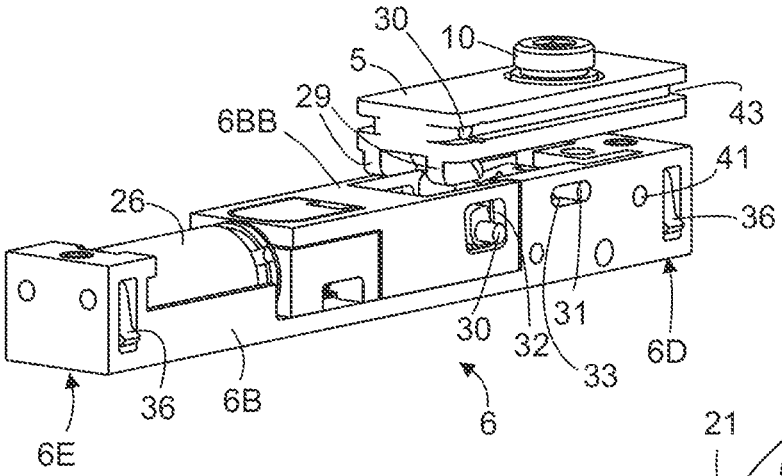
Figure 15:
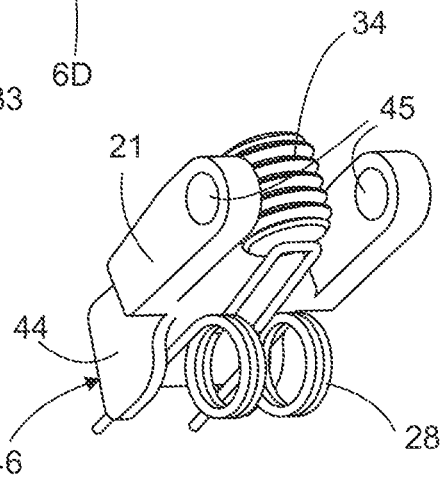
Figure 16:
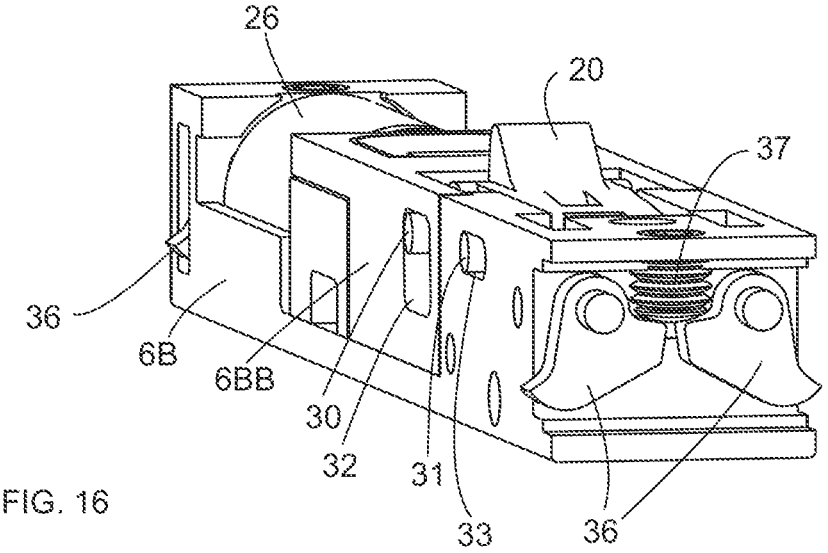

In the following, the invention is described in more detail by reference to the enclosed drawings, where FIG. 1 illustrates an example of a hold-open arrester arrangement according to the invention when installed on a door, FIG. 2 illustrates an embodiment of the hold-open arrester arrangement according to the invention when an arrester unit is just passing a sliding block towards the cam and the rear end of the arrester unit, FIG. 3 illustrates another view of the situation of FIG. 2, FIG. 4 illustrates the hold-open arrester arrangement according to the invention when the sliding block is passing the cam when moving towards the rear end of the arrester unit, FIG. 5 illustrates another view of the situation of FIG. 4, FIG. 6 illustrates the hold-open arrester arrangement according to the invention when the sliding block has passed the cam and is at the rear end of the arrester unit, FIG. 7 illustrates another view of the situation of FIG. 6, FIG. 8 illustrates the hold-open arrester arrangement according to the invention when the sliding block is hold within the arrester unit, FIG. 9 illustrates another view of the situation of FIG. 8, FIG. 10 illustrates the hold-open arrester arrangement according to the invention where the hold-open function is released and the sliding block is moving away from the arrester unit, FIG. 11 illustrates another view of the situation of FIG. 11, FIG. 12 illustrates a view of the locking lever and the slide element, FIG. 13 illustrates the hold-open arrester arrangement according to the invention where the hold-open function is released, the sliding block is moving away from the arrester unit, and slide element is at the arresting position, FIG. 14 illustrates another view of the situation of FIG. 13, FIG. 15 illustrates the overload lever 21, and FIG. 16 illustrates the arrester unit.

DESCRIPTION OF THE INVENTION

FIG. 1 illustrates an example of a hold-open arrester arrangement according to the invention when installed on a door. The installation 1 comprises a door closer 2, an arm 3 of a door closer and a slide rail 4. In this example the door closer has been installed on the door 7. The slide rail has been installed on a door frame 8. The door has been attached to the frame via the hinges 9. The slide rail has a sliding block 5 that is arranged to move in a sliding manner along the rail. The sliding block is also pivotable connected to the arm 3 of the door closer.

An arrester unit 6 has also been installed in the slide rail 4 in a fixed manner. It provides a hold-open function in order to hold the door open. The place of the installed arrester unit is selected so that hold-open arrester arrangement is going to hold the door open at the desired opening angle of the door.

When the door 7 is opened from the closed position, the door closer 2 tensions for closing the door after the opening. At the same time the arm 3 pivots, and the sliding block 5 moves along the to slide rail 4 towards the arrester unit 6 and the hinge side 7A of the door. When the door has been opened so that the sliding block 5 passes the arrester unit 6, the hold-open function is formed between the sliding block 5 and the arrester unit 6 in order to hold the door open. More specifically, the hold-open function is performed between the pivoted lever 12 of the sliding block 5 and the cam 20 of the locking lever 19 in the arrester unit 6, which is described in more detail below.

So, an example of the inventive embodiment has a hold-open arrester arrangement having a hold-open function to hold a door open. The arrangement has also an electric release arrangement, which is arranged to release the hold-open function in a fire alarm situation. The arrangement comprises also a sliding block 5 and an arrester unit 6. The sliding block 5 is connectable with a slide rail 4 in a sliding manner and also pivotable connectable to an arm 3 of a door closer. The arrester unit 6 is also connectable to the slide rail 4 and it has a body 6B, the electric release arrangement, and said hold-open function with the sliding block 5. The body has a front end 6D and a rear end 6E.

FIGS. 2-11 and 13-14 show embodiments of the arrester unit 6 and the sliding block 5 according to the invention in more detail. Some features are illustrated quite schematically. FIGS. 12, 15, and 16 illustrate some details of the invention. The sliding block 5 comprises a support surface 11 and a pivoted lever 12 having a front surface 13 and a back surface 15. The pivoted lever is spring biased towards a locking position where the front surface 13 is in contact with the support surface 11. The arrester unit 6 comprises a locking lever 19 having a cam 20. The arrester unit comprises also a slide element 14 being spring-biased towards an arresting position of the slide element 14. The slide element 14 at the arresting position is arranged to keep the locking lever 19 at a holding location. The cam 20 is out of the body 6B at the holding location of the locking lever. The arresting position can, for example, be seen in FIG. 2. Further the slide element at the arrester position prevents the locking lever to move away from the holding location. The holding location can also be seen, for example, in FIG. 2.

In FIGS. 2 and 3 the sliding block 5 is passing the arrester unit 6 and moving towards rear end 6E of the arrester unit, in other words towards in hinge side 7A of the door when installed. The pivoted lever 12 is arranged to turn due to the cam 20 when the sliding block 5 is passing the arrester unit 6 towards the rear end 6E of the arrester unit. The pivoted lever 12 is also arranged to turn back to the locking position after passing the cam 20 whereby the arrester unit 6 provides said hold-open function due to the cam 20 being out of the body 6B. FIGS. 4 and 5 show a situation where the pivoted lever 12 is turned by the cam 20. FIGS. 8 and 9 illustrate how the hold-open function works. The hold-open function prevents the sliding block to pass the cam and thus the arrester unit also towards and passing the front end 6D of the arrester unit and towards the lock side of the door 7, in other words away from the hinge side 7A of door. Therefore the hold-open function provides locking connection with the hold-open arrester regarding the movement of the sliding block 5 passing the arrester unit towards the lock side 7B of the door.

The sliding block 5 is also capable to pass the rear end 6E of the arrester unit 6. FIGS. 6 and 7 show a situation where the sliding block 5 is at the rear end 6E and where it can also pass the arrester unit towards the hinge side 7A of the door as can be seen with FIG. 1. So, the door can also be turned fully opened passing the opening angle of the door where the hold-open arrester arrangement is arranged to keep the door open.

The electric release arrangement is arranged to move the slide element 14 towards the rear end 6E in case of fire alarm whereby releasing said locking lever 19 from the holding location allowing the sliding block 5 to move away from the arrester unit 6 by passing the front end 6D of the arrester unit. This action of the electric release arrangement is illustrated in FIGS. 10 and 11.

The arrester unit 6 further comprises an overload lever 21 being arranged to turn from its normal position in case a force from the sliding block 5 affecting to the overload lever 21 via the locking lever 19 is greater than a threshold force value. The turning of the overload lever 21 allows the locking lever 19 to move towards a front end 6D of the arrester unit, and to turn out of way of the sliding block. Thereby the movement of the sliding block 5 is allowed away from the arrester unit 6, and towards the lock side 7B of door (away from the hinge side of the door). The threshold force value is depend on a holding spring 28 that is arranged to bias the overload lever 21 to the normal position. FIGS. 13 and 14 show how the overload lever 21 work when the threshold force value is exceeded. The both ends of the locking lever 19 can comprise a pin or a roll 30, 31, which are located in guiding slots 32, 33 on the body 6B. Especially, utilizing the rolls the movements of the locking lever can be achieved easier because friction losses can be decreased if compared to the contacts between the parts 19, 14, 21 without the rolls. FIG. 12 shows in more detail the contacts between the locking lever, the slide element 14 and the overload lever 21. The guiding slots guide the movements of the locking lever 19 in relation to the body 6B.

The embodiment of the invention illustrated in the figures has the electric release arrangement comprising an electric drive 26 and a force transmitting mechanism 23, 24, 25 between the electric drive 26 and the slide element 14. The fire alarm can be detected from a fire alarm interface 38. The fire alarm interface provides fire alarm. The fire alarm interface can be a sensor or a connection to an external fire alarm arrangement. The arrester unit has a circuit board or the like 39, which is connected to the fire alarm interface 38 and arranged to control the electric drive 26 so that in case of fire alarm the electric drive moves the slide element 14 towards the rear end. FIGS. 10 and 11 show how the electric release arrangement has moved the slide element towards the rear end 6E, the circled detent has released from the holding location, and the sliding block 5 has moved away from the arrester unit 6. This movement of the sliding block can be achieved by the door closer.

When the hold-open function has been released by said electric release arrangement due to the fire alarm, i.e. fire situation. The arrester unit does not hold the door open, and the door closer turns the door to be closed. The door can still be opened by people who escape out because of the fire. The cam 20 does not hold the sliding block 5 because the locking lever 19 can turn out of way of the sliding block, so the door closer turns the door to the closed position. The slide element 14 is kept at the position illustrated in FIGS. 10 and 11 after the fire alarm, so therefore during the fire situation. After the end of fire situation, the electric release arrangement is arranged to create electrically a starting movement of the slide element 14 in order to move the slide element 14 to the arresting position by said spring-biasing. When the slide element has moved the arresting position, the inventive arrangement works as described above.

After the fire alarm when the slide element 14 has moved away from the arresting position, the slide element is kept away of the arresting position. This function is achieved by a self-locking feature of the electric release arrangement. The self-locking feature is released by said starting movement of the slide element, which is created electrically.

The end of the fire situation can be detected via the fire alarm interface 38. A signal indicating the end of the fire situation is received through the fire alarm interface 38, and as response to this signal the electric release arrangement is arranged to create electrically the starting movement of the slide element 14. The starting movement is enough strong to release the self-locking feature. After the self-locking has been released the spring-biasing moves the slide element to the arresting position.

The embodiment showed in the figures has the electric release arrangement comprises an electric drive 26 and a force transmitting mechanism 23, 24, 25, between the electric drive 26 and the slide element 14. The electric drive 26 can be an electric motor or a solenoid. The electric motor could be more convenient in many embodiments but the selection between the motor or the solenoid depends on many factors like costs, manufacturing reasons etc. The force transmitting mechanism can comprise a spring support part 23, a toothed bar 24, and worm gear 25, as in the embodiment of the figures. The spring support part 23 is attached to the toothed bar 24, and slideable connected with the slide element 14. It can also be seen in the figures that a bias spring 22 is between the slide element 14 and the toothed bar 24. The worm gear is in force transmitting connection to the toothed bar and the electric drive 26. The force transmitting connection between the worm gear and the electric drive 26 is direct or through a gear arrangement 27. In the direct connection the axis of the electric drive can be directly connected to the worm gear. If the gear arrangement 27 is used the axis of the electric drive is connected to the gear arrangement and another axis 25A connects the gear arrangement and the worm gear. The worm gear forms the self-locking feature with the toothed bar. It may also be possible that in embodiments using the gear arrangement 27, the gear arrangement forms the self-locking feature. The toothed bar 24 and the spring support part 23 fixed to the bar are arranged to be moveable in the body 6B, in a slideable manner.

The electric release arrangement can be constructed in many ways. For example, in a case where the electric drive is the solenoid having a plunger, the force transmitting mechanism may comprise a bar arrangement between the plunger and the slide element 14. The self-locking feature can be achieved by the gear arrangement or a bent axle, for example.

The hold-open arrester arrangement according to the invention comprises a power source 40 for the electric drive. The power source can be a battery or power interface for external power. The battery can be situated inside the arrester unit 6 or outside it, like in the slide rail 4. The external power source can be an electric power network.

Power for the electric drive, like the motor or the solenoid, is controlled by the circuit board comprising suitable switching functions and switches. As said the power source can be the battery or the electric power network for example. When the fire alarm is detected by a fire alarm interface 38, the circuit board or the like (integrated circuit board etc.) as response to the detection of the fire alarm provides power to the electric drive 26. The power to the electric drive controlled by the circuit board can be a relatively short power pulse, which is enough to move slide element 14 against the spring-biasing force. When the fire situation is ended it can be detected by the fire alarm interface 38 as well or by another interface. So, the inventive arrangement may have several interfaces for receiving different signals. As response of the detection of the end of the fire situation, the circuit board or the like can provide power to the electric drive in order to create electrically said starting movement of the slide element 14. This power for the starting movement can also be a relatively short power pulse.

As can be noted, the inventive arrangement is very power efficient since only short (in time) energy pulses are required with fire alarm situations and when setting the arrangement to a normal operation after the end of the fire situations. The normal operation occurs when there is no fire alarm/fire situation. During the normal operation when holding the door open, electric power is not used.

It can be seen in the figures that arrester unit 6 comprises space for the locking lever 19 to be at the holding location or away from the holding location. The slide element 14 has a slope 17 for guiding the locking lever 19 to the holding location and away from the holding location. In addition, the slide element can further comprise a holding surface 16 next to the slope 17. The holding surface is arranged to hold the locking lever 19 at the holding location, in the embodiment of the figures, but it should be noted that the slope 17 for guiding the circled detent can be arranged to hold the circled detent at the holding location.

In addition, it is also possible that the inventive arrangement comprises a sliding piece 18 between the slide element 14 and the body 6B. There can also be more than one sliding piece. The sliding piece 18 can be a ball or a roll. The sliding piece provides an easier movement of the slide element, and it is situated near the slope 17 and/or the possible holding surface 16 next to the slope 17. In this way the energy needed to move to slide element can be relatively minor when the fire alarm occurs or when the fire situation has been ended.

In order to have said spring-biasing of the slide element, the inventive embodiment comprises a bias spring 22, and the slide element 14 comprises a rod 14A. The rod has the attachment part 23A. The attachment part restricts the movement of the slide element 14 and the movement of a spring support part 23.

The bias spring 22 provides said spring-biasing of the slide element 14 towards the arresting position. The bias spring is between the main body of the slide element 14 and the spring support part 23. So, the tension of the spring occurs between the slide element 14 and the spring support part 23. The spring support part 23 is fixed to the toothed bar 24. The bias spring is on the rod 14A in the embodiment of the figures. As illustrated in the figures, the rod 14A may be moveable via a hole on the spring support part 23. The bias spring also protects the toothed bar 24 and the gear 25 and the motor 26 in cases of powerful movements of the door, which could break said parts of the arrester unit.

The sliding block 5 can also comprise space for the pivoted lever 12. See FIG. 4. The space receives the lever when it has been turned out of way of the sliding block by the cam, the sliding block moving towards the rear end 6E of the arrester unit 6. The pivoted lever 12 is hinged to the sliding block through axle stubs 42 providing the turning axis. As can be seen in the figures the sliding block 5 can comprise two projections 29 forming support surface extensions 11A, and the pivoted lever 12 can also comprise projections 12A extending the front surface 13. In this way the supporting surface 11/11A can be at the better place in view of the cam 20. See FIG. 8. The sliding block can also have a connection projection 10 for the arm 3 of the door closer As can be seen the arrester unit 6 comprises a control screw 34 in order to adjust tension of the holding spring 28. The tension of the spring 28 affects to said threshold force value. So, the threshold value force depends on the holding spring 28 and its control screw 34. FIG. 15 illustrates the control screw, the holding spring and the overload lever 21. When the force from the sliding block, affecting to the overload lever 21 via the locking lever 19, is greater than the threshold force value, the overload lever 21 turns, and the locking lever can move out of way of the sliding block 5. The overload lever 21 has holes 45 for a connecting the lever 21 in a pivotable manner to the body 6B, in other words having a hinged connection. The end 44 of the overload lever provides a surface/s 46, which is arranged to be against the locking lever 19 at the normal position. So, the normal position of the overload lever 21 is when the surface/s 46 is against the locking lever 19, more precisely against the rolls or pins 31, preventing the movement of the locking lever away from the holding location. As said, overload lever turns from its normal position in case a force from the sliding block 5, affecting to the overload lever 21 via the locking lever 19, is greater than a threshold force value. The embodiment of FIG. 5 has two projections having the surfaces 46, but the overload lever 21 can be formed another way as well.

Further as illustrated in the figures, the arrester unit 6 comprises a return spring 35 in order to guide the locking lever 19 towards the holding location. The holding location of the locking lever 19 can be seen in FIGS. 2 and 8, for example. In addition, the arrester unit 6 can comprise fixing hooks 36 and fixing screws 37 for fixing the arrester unit to the slide rail 4. FIG. 16 shows an embodiment of the fixing hooks and the fixing screws. This kind of arrangement makes it easy to fix the arrester unit 6 to a desired location in the slide rail 4.

The invention can be used with fire doors and also any other doors for preventing expansion of fire. The fire doors have been specifically designed to prevent expansion of fire. When fire alarm occurs the door/fire door can be closed automatically as described above. When there is no fire alarm it is possible to keep the door open. The door can also be open more than what the holding angle of the door is by the installed hold-open arrester arrangement. As said the power for the functions in case of the fire alarm or after the end of the fire for achieving back the hold-open function of the inventive arrangement, is supplied by external power supply, a supercapacitor or the battery, or a combination of these means. The battery can be rechargeable. The inventive arrangement can also be arranged so that in a power break down situation where voltage drops, the hold-open function is released, so the door is closed automatically. Further in cases of communication fails (for example with a fire alarm system or a security system) too long communication access time can cause the hold-open function to be released, and therefore closing the door automatically. So, the electric release arrangement can also be arranged to move the slide element 14 towards the rear end 6E in case of a fault situation (voltage drop, power failure, communication break etc.) whereby releasing said locking lever 19 from the holding location allowing the sliding block 5 to move away from the arrester unit 6 by passing the front end 6D of the arrester unit.

FIG. 1 shows the installation where the door closer has been installed on the door 7. and the slide rail on a door frame 8, but the installation can be opposite as well. The inventive arrangement can also be retrofitted to existing door closer arrangements. The inventive arrester unit 6 can be installed on an existing slide rail 4, and the inventive sliding can be connected to existing slide rail 4 and the existing arm 3 of the door closer.

As can be noted the invention can be made in many different ways, It is evident from the above that the invention is not limited to the embodiments described in this text but can be implemented in many other different embodiments within the scope of the independent claim.

The invention claimed is:

1. A hold-open arrester arrangement for a door closer and slide rail having a hold-open function to hold a door open, and having an electric release arrangement arranged to release the hold-open function in a fire alarm situation, wherein the hold-open arrester arrangement comprises:

a sliding block connectable with a slide rail in a sliding manner and also pivotably connectable to an arm of a door closer, the sliding block comprising:

a support surface; and a pivoted lever having a front surface and a back surface, the pivoted lever being spring biased towards a locking position where the front surface is in contact with the support surface; and an arrester unit connectable to the slide rail and having a body, the electric release arrangement, and said hold-open function with the sliding block, the body having a front end and a rear end, the arrester unit comprising:

a locking lever having a cam;

a slide element spring-biased towards an arresting position of the slide element, the slide element at the arresting position being arranged to keep the locking lever at a holding location, the cam being out of the body at the holding location; and an overload lever, wherein the pivoted lever is arranged to turn due to the cam when the sliding block is passing the arrester unit towards the rear end of the arrester unit, the pivoted lever also arranged to turn back to the locking position after passing the cam whereby the arrester unit providing said hold-open function due to the cam being out of the body, the sliding block being also capable of sliding toward the rear end of the arrester unit, wherein the electric release arrangement is arranged to move the slide element towards the rear end in case of fire alarm whereby releasing said locking lever from the holding location allowing the sliding block to move away from the arrester unit by passing the front end of the arrester unit, and wherein the overload lever is arranged to turn from its normal position in case a force from the sliding block affecting to the overload lever via the locking lever is greater than a threshold force value, the turning of the overload lever allowing the locking lever move towards a front end of the arrester unit, and to turn out of way of the sliding block, thereby allowing the movement of the sliding block away from the arrester unit, said threshold force value being depend on a holding spring that is arranged to bias the overload lever to the normal position.

2. The hold-open arrester arrangement according to claim 1, wherein the electric release arrangement is arranged to move the slide element to the arresting position by said spring-biasing after the end of fire situation.

3. The hold-open arrester arrangement according to claim 2, wherein the slide element has a slope for guiding the locking lever to the holding location and away from the holding location.

4. The hold-open arrester arrangement according to claim 3, wherein the sliding block comprises two projections forming support surface extensions, and the pivoted lever comprises also projections extending the front surface.

5. The hold-open arrester arrangement according to claim 3, wherein the electric release arrangement comprises an electric drive and a force transmitting mechanism between the electric drive and the slide element.

6. The hold-open arrester arrangement according to claim 5, comprising a fire alarm interface in order to provide fire alarm and a circuit board, which is connected to the fire alarm interface and arranged to control the electric drive so that in case of fire alarm the electric drive moves the slide element towards the rear end.

7. The hold-open arrester arrangement according to claim 6, wherein the electric drive is an electric motor or a solenoid.

8. The hold-open arrester arrangement according to claim 7, comprising a power source for the electric drive.

9. The hold-open arrester arrangement according to claim 8, wherein the power source is a battery or power interface for external power.

10. The hold-open arrester arrangement according to claim 6, wherein the fire alarm interface is a sensor or a connection to an external fire alarm arrangement.

11. The hold-open arrester arrangement according to claim 5, wherein the force transmitting mechanism comprises a spring support part, a toothed bar, and worm gear, the spring support part being attached to the toothed bar and slideable connected with the slide element and the toothed bar, the worm gear being in force transmitting connection to the toothed bar and the electric drive.

12. The hold-open arrester arrangement according to claim 11, wherein the force transmitting connection between the worm gear and the electric drive is direct or through a gear arrangement.

13. The hold-open arrester arrangement according to claim 7, wherein electric drive is the solenoid having a plunger, and the force transmitting mechanism comprises a bar arrangement between the plunger and the slide element.

14. The hold-open arrester arrangement according to claim 2, wherein both ends of the locking lever comprise a pin or a roll, which are located in guiding slots on the body.

15. The hold-open arrester arrangement according to claim 3, wherein the arrester unit comprises a control screw in order to adjust tension of the holding spring.

16. The hold-open arrester arrangement according to claim 15, wherein the slide element further comprises a holding surface next to the slope, the holding surface being arranged to hold the locking lever at the holding location.

17. The hold-open arrester arrangement according to claim 2, comprising at least one sliding piece between the slide element and the body.

18. The hold-open arrester arrangement according to claim 10, wherein the arrangement comprises a bias spring, and the slide element comprises a rod, the rod being in connection with the spring support part, which forms a support to the bias spring, which provides said spring-biasing of the slide element towards the arresting position.

19. The hold-open arrester arrangement according to claim 18, wherein the arrester unit comprises a return spring in order to guide the locking lever towards the holding location.

20. The hold-open arrester arrangement according to claim 19, wherein the arrester unit comprises fixing hooks and fixing screws for fixing the arrester unit to the slide rail.

21. The hold-open arrester arrangement according to claim 1, wherein the electric release arrangement is arranged to move the slide element towards the rear end in case of a fault situation whereby releasing said locking lever from the holding location allowing the sliding block to move away from the arrester unit by passing the front end of the arrester unit.

* * * * *